United States Patent [19]

Rhodes

[11] 4,173,165

[45] Nov. 6, 1979

[54] FIXEDLY MOUNTED MUTE FOR STRINGED INSTRUMENTS

[76] Inventor: Mordy M. Rhodes, 5056 N. Albany Ave., Chicago, Ill. 60625

[21] Appl. No.: 919,244

[22] Filed: Jun. 26, 1978

[51] Int. Cl.[2] ..... G10D 3/04

[52] U.S. Cl. ..... 84/311

[58] Field of Search ..... 84/310, 311

[56] References Cited

U.S. PATENT DOCUMENTS

| | | | |
|---|---|---|---|
| 1,671,871 | 5/1928 | Pardy | 84/311 |
| 2,765,692 | 10/1956 | Goldberger et al. | 84/311 |
| 3,440,917 | 4/1969 | Lemon | 84/311 |

*Primary Examiner*—Lawrence R. Franklin

*Attorney, Agent, or Firm*—Norman Lettvin

[57] ABSTRACT

A fixedly mounted mute for stringed instruments is provided through clamp means which permit selective manual securement and clamping to the portions of the strings located between the instrument's bridge and the string holder, or tailpiece, to which the strings secure. The construction takes advantage of the characteristics of the material of the clamp means and is of such nature as to prevent dislodgement, or movement thereof due to vibration from the instrument or due to manual manipulation of the mute between operative and inoperative positions. The size of the attachment is nominal so as to render the attachment compatible with the interior dimensions of existing carrying cases for the instruments.

9 Claims, 6 Drawing Figures

FIXEDLY MOUNTED MUTE FOR STRINGED INSTRUMENTS

This invention relates to a fixedly mounted mute for stringed instruments, and more particularly relates to the clamp means for selectively securing the fixedly mounted mute to the stringed instrument.

BRIEF SUMMARY OF THE INVENTION

Mutes for engagement with the bridge of stringed instruments have been used for generations. Until relatively recently, the mute was a part that was normally separate from the instrument, and was to be selectively applied by the musician to the bridge of the instrument or removed from the instrument, as required by the music's instructions. The separability of the mute from the instrument caused problems, such as by reason of the mute being misplaced, or being inadvertently dropped, or by the musician fumbling during the applying of the mute where the pace of the music would not afford sufficient time for manual application or removal.

Stringed instruments have inoperative portions of their strings positioned between the instrument's bridge and the tailpiece, or anchoring member, to which one end of the stretched strings are secured. Others have heretofore made efforts and proposed constructions to solve the aforesaid problems involving mutes. Such efforts by others recognized that the inoperative portions of the strings could provide a convenient region in which the mute could be fixedly located on the instrument for storage when not in use.

One proposed solution includes a slidable and liftable disc with a pair of large slide holes therethrough. The large holes receive inoperative portions of two strings therethrough, and the disc may be selectively slid toward and away from the bridge, with the large sized holes permitting vertical manipulation of the disc relative to the strings and bridge to permit a lip, formed on the disc, to be applied or removed from the upper edge of the bridge.

Another proposed solution includes a transverse mounting bar of a length to extend between a pair of strings, the mounting bar being of flexible character with slotted ends adapted for a press-fit attachment between the pair of strings, and with an elongated mute body provided at one end with a pivot knuckle that is arranged for pivotal mounting about the axis of the cross bar in the plane of the strings. The latter device carries the name of a famous violinist, "Yehudi Menuhin".

Problems observed with the latter construction include the fact that, in part due to the normal arrangement of strings in a slight converging relation rearwardly of the bridge, a relatively slight force, transmitted to the mounting bar located in the plane of the strings, can sometimes either totally dislodge the mounting bar or cause it to move along the length of the strings to a position where the bridge-engaging portion of the elongated mute body will no longer be properly vertically aligned with the upper edge of the bridge. Other problems arise because the spacing between the inoperative portions of the strings is not uniform from instrument to instrument, so that there also is required a degree of manual dexterity in applying the device in position in the first instance; and the location of the pivot axis of the mute body in the plane of the strings causes the mute head to attack, or begin entry onto, the upper edge of the bridge at an arc or unnatural angle. It should be understood that dislodgement of the mute body, or its movement out of desired position, during a musical performance could lead to an undesired musical performance.

Another proposed solution includes a formed wire clip, that engages and slides along inoperative portions of the strings, and carries a soft plastic roller which is caused to selectively engage the top of the bridge to effect a muting of the sound. This construction, because of the relatively loose engagement of the clip with the strings, has been observed to cause an undesirable buzzing sound, and the sliding movement has been observed to cause premature unravelling of wound portions of the strings.

The object of this invention is to provide a new and improved fixedly mounted mute which avoids the aforesaid problems, insuring against dislodgement or moving out of position, and which can be readily and simply applied for fixed mounting.

Another object of this invention is to provide a fixedly mounted mute construction which positively clamps against upper and lower edges of inoperative portions of the instrument's strings, thereby insuring against dislodgement or moving out of position.

A further object of this invention is to provide a fixedly mounted mute where the mute is selectively swingable between operative and inoperative positions about an axis spaced above the plane of the strings, so that the socket of the mute head attacks the upper edge of the bridge in substantially aligned relation, or at a correct angle.

Still another object of this invention is to provide a fixedly mounted mute construction which is constructed with such a specific character of material as to avoid flexing of the mounting, to avoid undesirable response to vibrations from the instrument, and thereby acting as a wolf suppressant.

Further objects and advantages will become apparent to one skilled in the art as the following description of the invention proceeds.

BRIEF DESCRIPTION OF THE DRAWINGS

FIG. 6 is a view of a modified form of construction of a portion of this invention, namely an integrally molded upper plate and the threaded attachment stud of non-circular cross-section.

DETAILED DESCRIPTION

Figure 1:
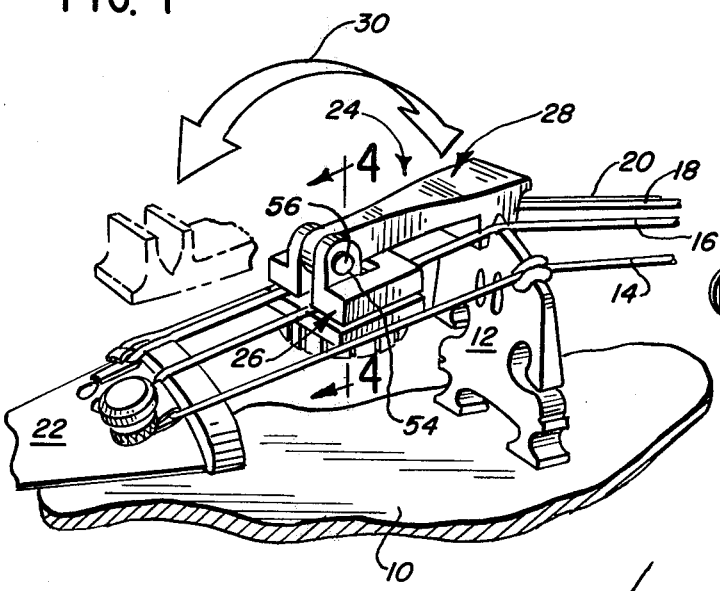
FIG. 1 is a fragmentary perspective view showing the permanently mounted mute of this invention secured in position on a violin-type instrument, and showing in full lines the bridge-engaging mute portion in its operative position, and also showing in broken lines the bridge-engaging mute portion as it would appear in its inoperative position.
Figure 2:
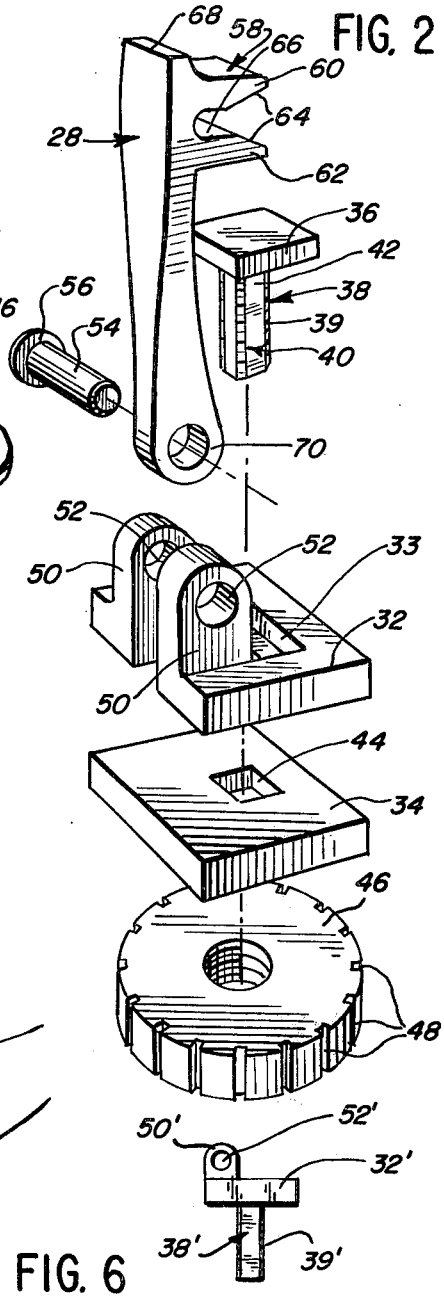
FIG. 2 is an enlarged, exploded view of one form of construction of the parts of the permanently mounted mute.

Referring now to the Figures in the drawing, reference is had to FIG. 1 which illustrates a fragment 10 of the soundboard of a violin upon which is supported the instrument's bridge 12. The four strings, 14, 16, 18, and 20 are trained over bridge 12 and are anchored to the string holder, or tailpiece, 22, as is well known in the art. The portions of the strings which extend between bridge 12 and tailpiece 22 are inoperative in the sense that they are not relied upon to produce the desired musical sound from the instrument.

The improvement of this invention is a fixedly mounted mute, illustrated generally at 24. The fixedly mounted mute 24 includes string engaging mounting means, generally indicated at 26, and an elongated mute member 28 which is pivotable between an operative position, shown in full lines in FIG. 1, and an inoperative position, indicated by broken lines in FIG. 1, the directions of selective swing or pivoting of the mute member 28 being substantially illustrated in the positions that bound the directional arrow indicated at 30.

The mounting means 26 as seen in FIG. 1 is of a width to both overlie and underlie portions of the two center strings 16 and 18. The mounting means 26 include two separable parts, an upper plate 32 and a lower plate 34 which have oppositely facing flat surfaces 33 and 35 that respectively engage the upper and lower edges of the inoperative portions of strings 16 and 18. The said plates 32 and 34 are arranged to be positively clamped against said strings to effectively provide an immovable support for the mute member 28.

In one form of the device illustrated, the upper plate 32 is formed of plastic and is provided with a counter sunk, non-circular or square, opening having an inwardly extending abutment shoulder 33 for receiving there against the non-circular or square head 36 of a bolt-like member 38. The member 38 is non-pivotable relative to plate 32. The stem 40 of the bolt-like member 38 had been initially screw threaded along its length, and is then provided with a non-circular periphery by providing four flatted surfaces 42 along the length of stem 38, so that screw threads remain only at the corners 39 of the stem 40. The threaded stem 38 serves as an attachment stud that projects downwardly relative to upper plate 32.

The lower plate 34 is also formed of plastic and is provided with a non-circular aperture 44 therethrough, of a size selected to cooperate with the four flat sides 42 of attachment stud 38 to prevent lower plate 34 from pivoting relative both to stud 38 and to the upper plate 32.

The attachment stud 38 is of sufficient length to project below lower plate 34, and is adapted to receive a threaded clamping nut 46, made of plastic, and provided with serrations or knurls 48 in the outer periphery of nut 46 for ease in manipulating. The diameter dimension of nut 46 is greater than the edge dimension of plates 32 and 34 to facilitate manipulation of nut 46.

Extending upwardly from upper plate 32 are a pair of spaced ears 50 which have been apertured to provide laterally aligned apertures 52 for purposes of receiving thereinto a pivot member 54 that also acts as the fulcrum for mute member 28. The pivot shaft 54 desirably is in the form of a ferrule, or tubular rivet, each of whose ends may be upset, as typically shown at 56, to form a head or clamping flange. When assembled and with two clamping flanges 56 formed, the rivet 54 operates to draw the ears 52 toward each other slightly for reasons that will appear hereinafter.

Figure 3:
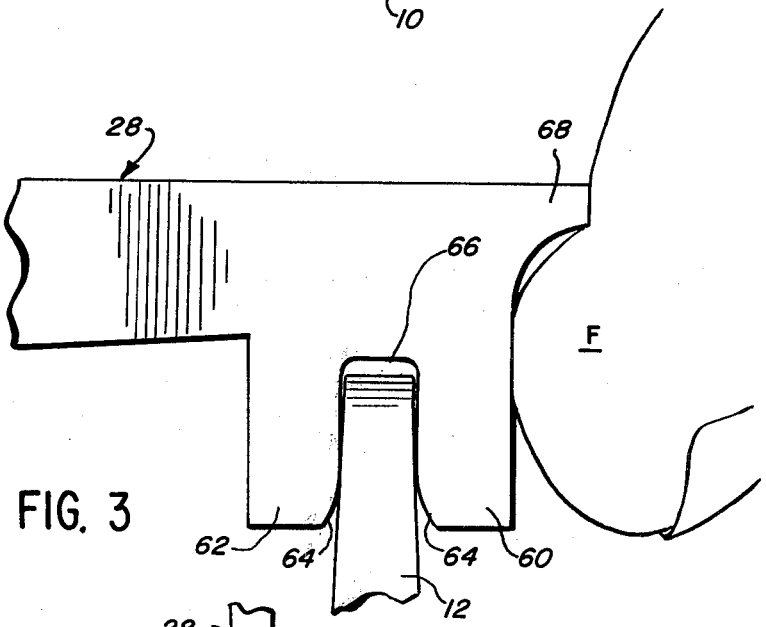
FIG. 3 is an enlarged fragmentary view in side elevation showing the bridge-engaging portion of the mute engaging the upper edge of the music instrument's bridge.
Figure 4:
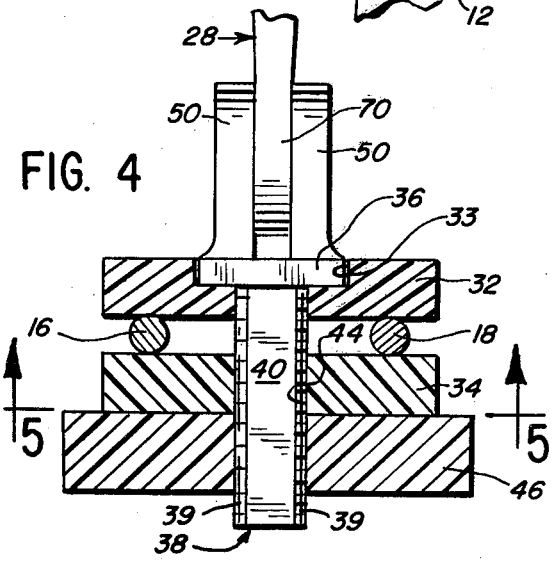
FIG. 4 is a vertical cross-sectional view taken substantially on line 4—4 of FIG. 1, showing details of construction of the form of device shown in FIG. 2.
Figure 5:
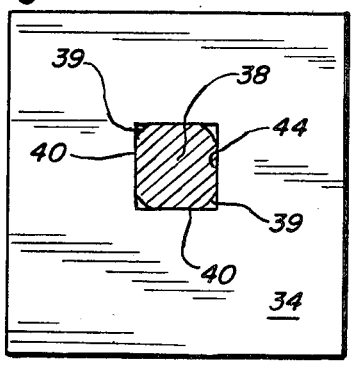
FIG. 5 is a cross-sectional view taken substantially on line 5—5 of FIG. 4, showing the non-circular cross-section of the threaded attachment stud cooperating with the aperture through the lower plate of the clamping means.

The mute member 28 is in the form of an elongated body, the free end of which is shaped to provide a bridge-engaging head 58. The mute's head 58 is laterally elongated, or wide, and generally of inverted, bifurcated, V-shape in cross-section to provide bridge-engaging portions 60 and 62 that are shaped at the entry end with flared, or diverging, entry surfaces 64 that merge with a central tapered recess 66 of a size adapted to receive the upper edge of bridge 12, as can best be seen in FIG. 3. Since the mute member 28 pivots about the axis of rivet or fulcrum 54 that is elevated to about the upper edge of bridge 12, the socket or recess of mute head 58 attacks the bridge 12 at a correct angle. The engagement of mute portions 60 and 62 with the surfaces of bridge 12 operate to provide a sound muting effect. The forwardmost portion of mute member 28 is provided with a forwardly extending upper flange 68 which provides a convenient control tab to be engaged by the musician's finger, F, as seen in FIG. 3, for purposes of lifting the mute member 28 from its operative position to move same to an inoperative position spaced from bridge 12.

The opposite end of mute member 28 is provided with an ear 70 apertured at 71, for pivoting about pivot shaft 54, at a position spaced above the plane of the mounting means 26 and of the strings 16–18. The ear 70 is of lesser lateral width than the mute's head 58. The width of ear 70 is selected to closely approximate the spacing between ears 50 on the upper plate 32 so as to be fitted between said ears. Then by slight distortion of ears 50 toward each other, under the bias of flanges 56 of rivet member 54, there will be developed sufficient position-retention friction between ears 50 and ear 70 of mute member 28, so that the mute member will be maintained in whatever selected position desired within the range of movement provided for.

Alternatively, the upper plate 32 may be provided with a single apertured upstanding support ear, and the mute member is provided with a pair of spaced deflectable ears that embrace the single ear on the upper plate, so that the biasing of the two ears of the mute member against the single support ear would develop the same type of position-retention friction between those relatively pivotable members.

Assembly of the device on the instrument will be understood from the foregoing description. The upper plate 32 and the bolt-like member 38 are assembled with the plate resting on the strings 16 and 18 and the threaded attachment stud 38 extending downwardly between said pair of strings. The lower plate 44 is then slid onto the attachment stud, to engage the underside of strings 16 and 18. Application of the nut 46 onto stud 38 provides means for applying a clamping bias so as to clamp the strings 16 and 18 between the plates 32 and 34, thereby attaching the mounting means 24 to the strings so as to provide an immovable support. The use of a plastic nut 46 provides a certain amount of resilience, or give, so that the normal tendency of a nut to be worked loose by vibrations, during the playing of the instrument, is avoided.

The mute member 28 is normally maintained in its inoperative position, as illustrated in broken lines in FIG. 1. In that position, the instrument with the fixedly mounted mute thereon will easily fit within existing carrying cases for the instrument. The lateral width of the mute's head 58 is selected to fit into the usual space provided between strings 16 and 18.

While in the form of device illustrated in FIGS. 1–5 the bolt-like member 38 is provided separate from the upper plate 32, it is contemplated that, to reduce costs, preferably plate 32 and member 38 would be molded as a single integral part of plastic, including threads 39, to provide a part such as shown illustratively in FIG. 6 where elements similar to those in FIGS. 1–5 are given the same reference numeral primed. Thus, in FIG. 6 there is illustrated the upper plate 32' with upstanding ear 50' and downwardly extending stud 38'. Alternatively, the head of the bolt-like member 38 of FIGS. 1–5 could be cemented to the upper plate 32 to achieve a one-piece configuration.

While the foregoing description of preferred forms discloses means for biasing plates 32 and 34 toward each other for clamping onto the instrument's strings by use of a manually adjustable threaded nut member 46 that cooperates with threaded attachment stud 38 or 38', it should be understood that other means could be used for biasing the separable plates 32 and 34 toward each other. Thus, a U-shaped spring clip, not shown, whose opposed legs, embrace the two plate with one leg engaging the upper surface of upper plate 32 and the other leg engaging the bottom surface of lower plate 34 could be used. Another alternative would be to provide a snap-type coupling between the upper plate 32 and lower plate 34. Such snap-type couplings are well known in other environments, where a shouldered stud on one member, such as the upper plate 32, is press fit through a shouldered aperture on the other member, such as the lower plate 34, the shoulders on the aperture then cooperating with the shoulders on the stud to hold the two members together. While such alternative constructions could be used, the threaded attachment stud and nut combination shown in the preferred forms is considered to be more reliable and effective to provide the positive clamping action that is desired.

While the parts of my improved mute, which I refer to as "PRESTO MUTE", preferably are formed of plastic, it will be understood that some of the parts could, alternatively, be formed of other materials, such as wood or metals.

While there has been disclosed and described a number of forms of the invention, it will be evident to one skilled in the art that various additional modifications may be made without departing from the spirit and scope of this invention as defined by the claims set forth hereinafter.

What is claimed is:

1. In a mute for a stringed instrument that is to be attached to portions of the instrument's strings, that are located between the instrument's bridge and the anchoring member to which the strings attach, by mounting means of a width to overlie and underlie portions of two strings and including upper and lower plate members for respectively engaging upper and lower edges of the strings and adapted to be positively clamped onto said strings to provide an immovable support; the improvement comprising in combination:

an elongated mute member pivotly mounted at one end thereof on one of said members for swinging only about a horizontal axis between an operative position, in which the mute member extends above and across said upper plate member to have its other end engage the instrument's bridge, and an inoperative position, and selectively operable clamping means operatively associated with said upper and lower plate member for biasing said members toward each other to clamp portions of strings of the instrument therebetween and to selectively locate the mounting means and mute member in position longitudinally of the strings, so that the mute member will be properly positioned to be selectively swung between operative and inoperative positions, said clamping means including a rotatable member positioned below the lower plate member in a plane spaced away from the region in which the mute member is pivoted to swing between operative and inoperative positions, whereby swinging of the mute member and manipulation of the rotatable member of the clamping means may each be separately effected without interference with the other.

2. A mute as in claim 1 wherein the diameter of the rotatable member is greater than the edge dimension of the lower plate.

3. A mute as in claim 1 wherein the horizontal pivot axis is spaced above the plane of the upper plate member.

4. A mute as in claim 1 including a pair of ears extending upwardly of the upper plate and supporting therebetween a horizontal pivot pin on which the mute member is pivotly mounted.

5. In a mute for a stringed instrument that is to be attached to portions of the instrument's strings that are located between the instrument's bridge and the anchoring member to which the strings attach, by mounting means of a width to overlie and underlie portions of two strings and including upper and lower plates for respectively engaging upper and lower edges of two strings and adapted to be positively clamped onto said strings to provide an immovable support, the improvement comprising, in combination:

the lower plate being apertured, a threaded attachment stud extending downwardly from the upper plate through the aperture of the lower plate, and below said lower plate;

a mute member pivotly mounted on said mounting means;

a nut member mounted on the threaded attachment stud and being selectively manually adjustable to bias the two plates toward each other to clamp portions of the strings of the instrument therebetween, to provide the positive clamping of the mounting means onto the strings of the instrument; and the threaded attachment stud being non-pivotable relative to the upper plate and having a non-circular cross-section, and the aperture in the lower plate through which the stud extends being non-circular to cooperate with the non-circular cross-section of the stud to prevent pivoting of the lower plate relative to the upper plate.

6. A device as in claim 5 wherein said upper plate and said attachment stud are integrally molded of plastic, and the lower plate is also formed of plastic to provide a character of material, with which the nut member cooperates, to develop sufficient friction to avoid inadvertent loosening of the hut member by the vibrations developed during the playing of the stringed instrument.

7. A device as in claim 5 including a mute support means provided on the mounting means and providing a pivot thereon, spaced above the plane of the strings, about which the mute member pivots.

8. A device as in claim 7 wherein the mute support means includes a pair of closely spaced, apertured ears;

the mute member being an elongated body with a bridge-engaging, laterally elongated, bifurcated head at one end and an apertured mounting ear at the other end;

said mounting ear being of a lateral dimension to closely fit between said pair of closely spaced ears of the support means; and a headed pivot member extending through the three apertured ears and operating to hold the ears together to develop position-retention friction between the pivotable mute member and the spaced ears of the support means.

9. A device as in claim 5 wherein the construction of the nut member is of a plastic material, so that engagement thereof with other portions of the mounting means develops substantial friction which prevents loosening of the nut and mounting means under vibrations developed during playing the instrument.

* * * * *